US007474288B2

(12) United States Patent
Smith et al.

(10) Patent No.: US 7,474,288 B2
(45) Date of Patent: Jan. 6, 2009

(54) DISPLAY DRIVER CIRCUITS FOR ORGANIC LIGHT EMITTING DIODE DISPLAYS WITH SKIPPING OF BLANK LINES, METHOD OF REDUCING POWER CONSUMPTION OF A DISPLAY, PROCESSOR CONTROL CODE TO IMPLEMENT THE METHOD, AND CARRIER FOR THE CONTROL CODE

(75) Inventors: Euan C. Smith, Longstanton (GB); Paul R. Routley, Longstanton (GB); William Goodchild, Brighton (GB)

(73) Assignee: Cambridge Display Technology Limited, Cambridge (GB)

( * ) Notice: Subject to any disclaimer, the term of this patent is extended or adjusted under 35 U.S.C. 154(b) by 185 days.

(21) Appl. No.: 10/512,379

(22) PCT Filed: Apr. 22, 2003

(86) PCT No.: PCT/GB03/01712

§ 371 (c)(1),
(2), (4) Date: Jun. 6, 2005

(87) PCT Pub. No.: WO03/091983

PCT Pub. Date: Nov. 6, 2003

(65) Prior Publication Data

US 2005/0219163 A1 Oct. 6, 2005

(30) Foreign Application Priority Data

Apr. 25, 2002 (GB) ..... 0209502.4
May 21, 2002 (GB) ..... 0211735.6

(51) Int. Cl.
*G09G 3/32* (2006.01)

(52) U.S. Cl. ..... 345/83; 345/76

(58) Field of Classification Search ..... 345/204, 345/76, 77, 82–83; 315/169.3
See application file for complete search history.

(56) References Cited

U.S. PATENT DOCUMENTS 4,539,507 A 9/1985 VanSlyke et al. ..... 313/504

(Continued)

FOREIGN PATENT DOCUMENTS

EP 811 866 A1 12/1997

(Continued)

OTHER PUBLICATIONS

International Search Report in PCT/GB03/01712 dated Aug. 7, 2003.

*Primary Examiner*—Amr Awad
*Assistant Examiner*—Yong Sim
(74) *Attorney, Agent, or Firm*—Marshall, Gerstein & Borun LLP

(57) ABSTRACT

Display driver circuits are described for driving organic light-emitting diode displays, particularly passive matrix displays, with greater efficiency. Display driver circuitry includes a frame memory interface for reading data from a frame memory for presentation on a passive matrix OLED display. A blank line identifier identifies one or more substantially blank rows of pixels defined by the data in the frame memory and the control circuitry skips past these rows when the passive matrix display is addressed. When blank lines are skipped the apparent brightness of the remaining lines increases and thus preferably the control circuitry includes a power-controller for reducing a power supply to the display in proportion to the number of skipped lines. The disclosed circuitry is particularly suited to a display driver providing a controlled current drive.

16 Claims, 6 Drawing Sheets

U.S. PATENT DOCUMENTS

| | | | | |
|---|---|---|---|---|
| 4,823,121 | A * | 4/1989 | Sakamoto et al. | 345/78 |
| 5,923,308 | A * | 7/1999 | Wei et al. | 345/44 |
| 6,014,119 | A | 1/2000 | Staring et al. | 345/82 |
| 6,037,919 | A * | 3/2000 | Hanson | 345/87 |
| 6,075,510 | A | 6/2000 | Blouin et al. | 345/99 |
| 6,201,520 | B1 | 3/2001 | Iketsu et al. | 345/76 |
| 6,323,849 | B1 | 11/2001 | He et al. | 345/204 |
| 6,332,661 | B1 | 12/2001 | Yamaguchi | 317/108 |
| 2001/0035713 | A1 * | 11/2001 | Kimura | 313/501 |
| 2002/0067351 | A1 * | 6/2002 | Kim | 345/204 |
| 2002/0196213 | A1 * | 12/2002 | Akimoto et al. | 345/82 |

FOREIGN PATENT DOCUMENTS

| | | | |
|---|---|---|---|
| EP | 1 079 361 | A1 | 2/2001 |
| EP | 1 091 339 | A2 | 4/2001 |
| EP | 1 091 339 | A3 | 4/2001 |
| WO | WO 90/13148 | | 11/1990 |
| WO | WO 95/06400 | | 3/1995 |
| WO | WO 99/48160 | | 9/1999 |

* cited by examiner

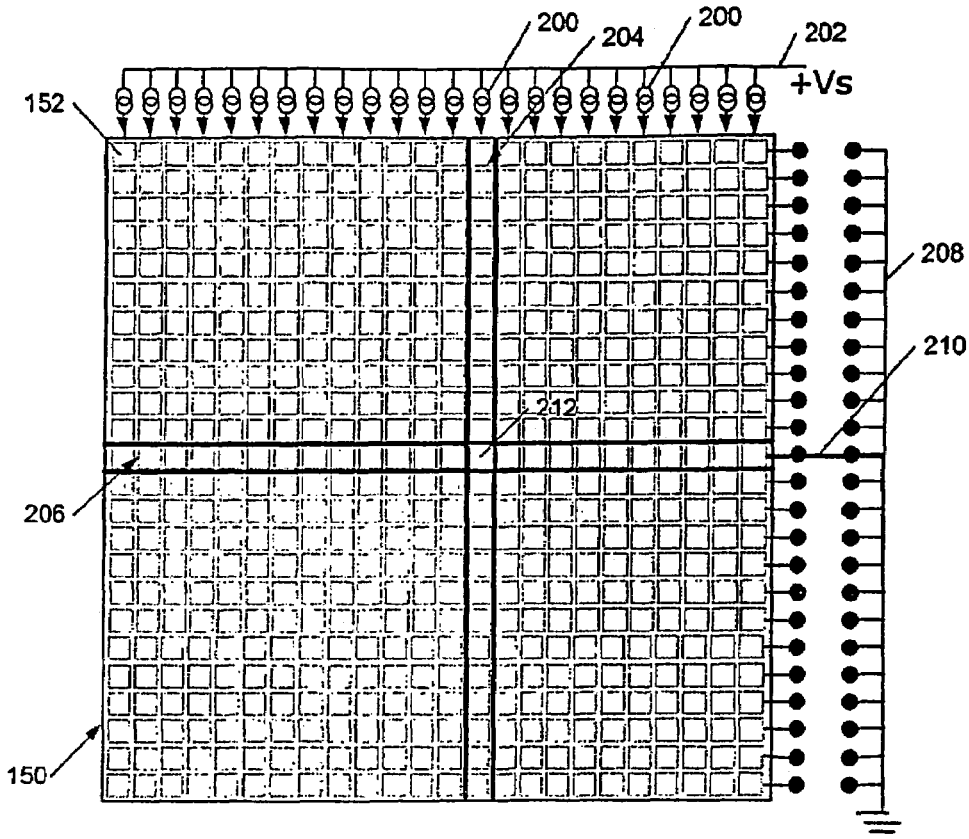
Figure 2a
Figure 2b
Figure 2c
Figure 2d
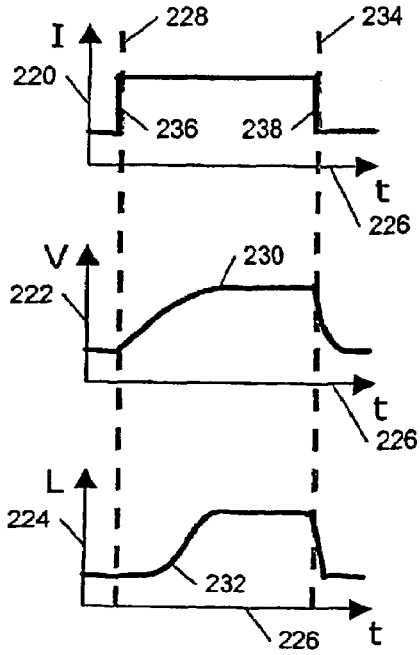

300

DISPLAY DRIVER CIRCUITS FOR ORGANIC LIGHT EMITTING DIODE DISPLAYS WITH SKIPPING OF BLANK LINES, METHOD OF REDUCING POWER CONSUMPTION OF A DISPLAY, PROCESSOR CONTROL CODE TO IMPLEMENT THE METHOD, AND CARRIER FOR THE CONTROL CODE

This is the U.S. national phase of International Application No. PCT/GB03/01712 filed Apr. 22, 2003, the entire disclosure of which is incorporated herein by reference.

This disclosure generally relates to display driver circuits for electro-optic displays, and more particularly relates to circuits and methods for driving organic light emitting diode displays, especially passive matrix displays, with greater efficiency.

RELATED TECHNOLOGY

Organic light emitting diodes (OLEDs) comprise a particularly advantageous form of electro-optic display. They are bright, colourful, fast-switching, provide a wide viewing angle and are easy and cheap to fabricate on a variety of substrates. Organic LEDs may be fabricated using either polymers or small molecules in a range of colours (or in multi-coloured displays), depending upon the materials used. Examples of polymer-based organic LEDs are described in WO 90/13148, WO 95/06400 and WO 99/48160; examples of so called small molecule based devices are described in U.S. Pat. No. 4,539,507.

A basic structure 100 of a typical organic LED is shown in FIG. 1*a*. A glass or plastic substrate 102 supports a transparent anode layer 104 comprising, for example, indium tin oxide (ITO) on which is deposited a hole transport layer 106, an electroluminescent layer 108, and a cathode 110. The electroluminescent layer 108 may comprise, for example, a PPV (poly(p-phenylenevinylene)) and the hole transport layer 106, which helps match the hole energy levels of the anode layer 104 and electroluminescent layer 108, may comprise, for example, PEDOT:PSS (polystyrene-sulphonate-doped polyethylene-dioxythiophene). Cathode layer 110 typically comprises a low work function metal such as calcium and may include an additional layer immediately adjacent electroluminescent layer 108, such as a layer of aluminum, for improved electron energy level matching. Contact wires 114 and 116 to the anode the cathode respectively provide a connection to a power source 118. The same basic structure may also be employed for small molecule devices.

In the example shown in FIG. 1*a* light 120 is emitted through transparent anode 104 and substrate 102 and such devices are referred to as "bottom emitters". Devices which emit through the cathode may also be constructed, for example by keeping the thickness of cathode layer 110 less than around 50-100 nm so that the cathode is substantially transparent.

Organic LEDs may be deposited on a substrate in a matrix of pixels to form a single or multi-colour pixellated display. A multicoloured display may be constructed using groups of red, green, and blue emitting pixels. In such displays the individual elements are generally addressed by activating row (or column) lines to select the pixels, and rows (or columns) of pixels are written to, to create a display. So-called active matrix displays have a memory element, typically a storage capacitor and a transistor, associated with each pixel whilst passive matrix displays have no such memory element and instead are repetitively scanned, somewhat similarly to a TV picture, to give the impression of a steady image.

FIG. 1*b* shows a cross section through a passive matrix OLED display 150 in which like elements to those of FIG. 1*a* are indicated by like reference numerals. In the passive matrix display 150 the electroluminescent layer 108 comprises a plurality of pixels 152 and the cathode layer 110 comprises a plurality of mutually electrically insulated conductive lines 154, running into the page in FIG. 1*b*, each with an associated contact 156. Likewise the ITO anode layer 104 also comprises a plurality of anode lines 158, of which only one is shown in FIG. 1*b*, running at right angles to the cathode lines. Contacts (not shown in FIG. 1*b*) are also provided for each anode line. An electroluminescent pixel 152 at the intersection of a cathode line and anode line may be addressed by applying a voltage between the relevant anode and cathode lines.

Referring now to FIG. 2*a*, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative and with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Alternatively a row may be selected and all the columns written in parallel, that is a row selected and a current driven onto each of the column lines simultaneously, to simultaneously illuminate each pixel in a row at its desired brightness. Although this latter arrangement requires more column drive circuitry it is preferred because it allows a more rapid refresh of each pixel. In a further alternative arrangement each pixel in a column may be addressed in turn before the next column is addressed, although this is not preferred because of the effect, inter alia, of column capacitance as discussed below. It will be appreciated that in the arrangement of FIG. 2*a* the functions of the column driver circuitry and row driver circuitry may be exchanged.

It is usual to provide a current-controlled rather than a voltage-controlled drive to an OLED because the brightness of an OLED is determined by the current flowing through it, this determining the number of photons it outputs. In a voltage-controlled configuration the brightness can vary across the area of a display and with time, temperature, and age, making it difficult to predict how bright a pixel will appear when driven by a given voltage. In a colour display the accuracy of colour representations may also be affected.

FIGS. 2*b* to 2*d* illustrate, respectively, the current drive 220 applied to a pixel, the voltage 222 across the pixel, and the light output 224 from the pixel over time 226 as the pixel is addressed. The row containing the pixel is addressed and at the time indicated by dashed line 228 the current is driven onto the column line for the pixel. The column line (and pixel) has an associated capacitance and thus the voltage gradually rises to a maximum 230. The pixel does not begin to emit light until a point 232 is reached where the voltage across the pixel is greater than the OLED diode voltage drop. Similarly when the drive current is turned off at time 234 the voltage and light output gradually decay as the column capacitance discharges. Where the pixels in a row are all written simultaneously, that is where the columns are driven in parallel, the time interval between times 228 and 234 corresponds to a line scan period.

It is desirable to be able to provide a greyscale-type display, that is one in which the apparent brightness of individual pixels may be varied rather than simply set either on or off. In the context of this invention "greyscale" refers to such a variable brightness display, whether a pixel is white or coloured.

The conventional method of varying pixel brightness is to vary pixel on-time using Pulse Width Modulation (PWM). In the context of FIG. 2*b* above the apparent pixel brightness may be varied by varying the percentage of the interval between times 228 and 234 for which drive current is applied. In a PWM scheme a pixel is either fill on or completely off but the apparent brightness of a pixel varies because of integration within the observer's eye.

Pulse Width Modulation schemes provide a good linear brightness response but to overcome effects related to the delayed pixel turn-on they generally employ a precharge current pulse (not shown in FIG. 2*b*) on the leading edge 236 of the driving current waveform, and sometimes a discharge pulse on the trailing edge 238 of the waveform. As a result, charging (and discharging) the column capacitance can account for roughly half the total power consumption in displays incorporating this type of brightness control. Other significant factors that contribute to the power consumption of a display plus driver combination include dissipation within the OLED itself (a function of OLED efficiency), resistive losses in the row and column lines and, importantly in a practical circuit, the effects of a limited current driver compliance, as explained in more detail below.

FIG. 3 shows a schematic diagram 300 of a generic driver circuit for a passive matrix OLED display. The OLED display is indicated by dashed line 302 and comprises a plurality n of row lines 304 each with a corresponding row electrode contact 306 and a plurality m of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 318. A power supply 320 provides power to the circuitry and, in particular, to y-driver 314.

Specific examples of OLED display drivers are described in U.S. Pat. Nos. 6,014,119, 6,201,520, 6,332,661, EP 1,079,361A and EP 1,091,339A; OLED display driver integrated circuits are also sold by Clare Micronix of Clare, Inc., Beverly, Mass., USA. The Clare Micronix drivers provide a current controlled drive and achieve greyscaling using a conventional PWM approach; U.S. Pat. No. 6,014,119 describes a driver circuit in which pulse width modulation is used to control brightness; U.S. Pat. No. 6,201,520 describes driver circuitry in which each column driver has a constant current generator to provide digital (on/off) pixel control; U.S. Pat. No. 6,332,661 describes pixel driver circuitry in which a reference current generator sets the current output of a constant current driver for a plurality of columns, but again this arrangement is not suitable for variable brightness displays; and EP 1,079,361A and EP 1,091,339A both describe similar drivers for organic electroluminescent display elements in which a voltage drive rather than a current drive is employed.

It is generally desirable to reduce the power consumption of the display plus driver combination, particularly while retaining the ability to provide a greyscale display. It is further desirable to reduce the maximum required power supply voltage for the display plus driver combination.

Prior art techniques for reducing the power consumption of liquid crystal displays (LCDs) are described in U.S. Pat. No. 6,323,849 and EP 0 811 866A. U.S. Pat. No. 6,323,849 describes an LCD display with a partial display mode in which a control circuit controls display drivers to turn off a portion of the display which does not show useful information. When the LCD module is in a partial display mode the line frequency may also be reduced whilst maintaining the same frame refresh rate, allowing a lower voltage to be used to produce the same amount of charge. However, a user must predetermine which portion of the display is to be used, which will typically require additional control functions and software in the device for which the display is provided. EP 0 811 866A describes a similar technique, albeit with a more flexible driving arrangement. It will therefore be appreciated that there is a need for an improved reduced power consumption display driver which provides for more transparent user implementation.

U.S. Pat. No. 4,823,121 describes an electroluminescent (EL) panel driving system which detects the absence of a HIGH level signal representing a spot illumination of the EL panel in the image data of a line and, in response to this, prevents four circuits (a pre-charge circuit, a pullup circuit, a write-in circuit and a source circuit) from being activated. However the power savings provided by this technique are specific to the drive arrangement for the type of electroluminescent panel described and are not readily generalisable. Furthermore the savings are relatively modest.

The present disclosure recognizes that substantial additional power savings may be achieved with emissive display technology, and in particular with organic light emitting diode-based displays.

FIG. 4*a* shows a typical light intensity-voltage curve 400 for an OLED which, as can be seen, is non-linear. It is desirable to operate an OLED display at a lower rather than a higher voltage as this increases the device's efficiency (light output in terms of energy input) and reduces the degradation rate. Resistive losses are also reduced and, where image data is changing, capacitive losses (which depend upon the square of the voltage) are also reduced. It can be seen from curve 400 that one problem with working at a low voltage is the disproportionately reduced light intensity. However, there are circumstances in which the perceived brightness of a scanned, passive matrix-type display may be maintained while operating at a reduced voltage and hence a reduced light intensity output from individual pixels. In particular, there will often be one or more entirely blank (non-emitting) lines on a pixellated display, especially in certain applications such as mobile phones and personal digital assistants (PDAs). In such circumstances these blank lines may be skipped over so that the scarring process may dwell longer on the lines with illuminated pixels. Thus as perceived by the eye, which performs an integration process, the illuminated lines appear brighter or, equivalently, the same apparent brightness may be achieved using a reduced voltage drive. Further savings may be made using a current drive provided by a controllable current source powered by a variable voltage power supply, as described in more detail below.

According to a first aspect of the disclosure there is therefore provided a display driver control circuitry for a passive matrix emissive display, the display comprising a plurality of pixels arranged in rows and columns and addressed by row and column electrodes, the control circuitry being configured to address each row in turn to give the appearance of an image on the display, the control circuitry further comprising a frame memory interface for reading data from a frame memory for presentation on the display; and a blank line identifier for identifying one or more substantially blank rows of pixels defined by said data; and wherein the control circuitry is further configured to skip past said one or more blank rows of pixels during said row addressing.

By skipping past the blank or non-illuminated lines the remaining lines may be refreshed faster or illuminated for longer and can thus be driven at a reduced level whilst retaining the same apparent brightness. For example a 64 line display with a 60 Hz frame refresh rate has a line refresh rate of 3.84 KHz and a line period of 0.26 ms, but if only 16 lines have illuminated pixels the line period may be increased to approximately 4.2 ms, making the lines appear 16 times brighter, whilst retaining the same frame refresh rate. By identifying one or more substantially blank rows of pixels within the data for display there is no need to predetermine which portions of the display are used and which are not. This is particularly useful where it is not easy to determine in advance which part or parts of the display will contain substantially blank rows of pixels, for example when displaying text or providing a scrolling display.

It will be appreciated that the frame memory interface may be an internal or an external interface. For example the control circuitry may comprise part of the circuitry of an integrated circuit on which the frame memory and, optionally, row and/or column drivers may be included. The frame memory is useful for retiming the data for presentation on the display and also provides a buffer which may be read to identify the blank rows and, optionally, to count them. However a frame memory is not essential for identifying blank rows as this may also be done, for example, by bus snooping, as described later. The skilled person will further recognise that the row and column labelling is essentially arbitrary and that for the purposes of the invention it is immaterial whether blank rows or blank columns are skipped.

The control circuitry may operate so as to maintain a substantially constant line rate so that as fewer lines are displayed the frame rate increases. However this mode of operation is less preferable than one in which the frame rate is kept substantially constant and the line rate is adjusted so that as fewer lines are displayed the line rate reduces. This is because by reducing the line rate power dissipation in capacitances associated with the display elements may be reduced. In both cases, however, the drive to the display may be reduced.

Additional power savings may be made in a current driven display, such as an OLED display, in which the brightness of a display element is varied by varying the current through the element. In this type of display the current drive for a row or column is typically provided by a variable or controllable constant current source.

A current source attempts to deliver a substantially constant current to the load to which it is connected but it will be appreciated that there will come a point as its output voltage approaches the supply voltage, at which this is no longer possible. The range of voltages over which a current source provides an approximately constant current to a load is termed the compliance of the current source. The compliance can be characterised by ($V_S$-$V_O$) where $V_S$ is the supply voltage and $V_O$ is substantially the maximum output voltage of the current source in that when $V_S$-$V_O$ is small the compliance is high, and vice-versa. (For convenience in this specification reference will be made to a current source and to current sources but these may be substituted by a current sinks or sinks).

The lower the maximum substantially constant current output required from the current source, the lower the required supply voltage. Thus in a current driven display where the maximum current drive is reduced, because fewer lines on the display are illuminated, the supply voltage to the current source may be reduced. Thus preferably the display driver control circuitry provides an output for controlling a power supply voltage provided to a (variable) current drive to the display. The control circuitry may also provide a current reference level output for setting a reference current drive level such as a maximum current drive level.

The power supply is preferably of the voltage converter type, such as a switch mode power supply, so that the output voltage of the power supply may be reduced maintaining the power supply efficiency. It will be recognised that the power supply may be controlled either directly, for example by means of a direct control signal from the control circuitry, or indirectly, for example by setting a maximum or reference drive current level and controlling the power supply to ensure this reference level of current can be provided. Preferably the output voltage of the power supply is controlled so that it is not substantially more than that required by a current source (or sources or current sink or sinks) driving the display.

The lower the current driver compliance (i.e. the greater $V_8$-$V_0$), the greater the power losses due to limited driver compliance. It is therefore preferable that a current driver with high compliance is employed because this will allow the use of a lower power supply output voltage. Thus preferably a current generator for the display comprises at least one bipolar transistor in series with a current drive output to the display and, preferably, this transistor has an emitter terminal substantially directly connected to a power supply input or connection, and a collector terminal coupled to an electrode driver output.

As before it will be recognised that the power supply connection and the above-described control circuitry outputs may be either internal or external connections or outputs, depending upon how the circuitry is implemented (for example on a single IC or shared between a plurality of integrated circuits and/or including discreet components). Likewise one or more controllable current generators may be included in the control circuitry.

The power supply and/or reference current control signals may be varied in proportion to the number of blank rows on the display. The number of blank rows may be determined by reading data from the frame memory and counting which rows are substantially blank. Alternatively a data bus for writing data into the frame memory may also provide an input to the control circuitry to allow the control circuitry to track data written into the frame memory and thus monitor changes to determine which, and optionally how many, rows are blank. With this latter technique the control circuitry may periodically check and/or reset the change tracking by reading data from the frame memory.

The control circuitry may optionally be further configured to vary a line or row display period dependent upon the brightness of pixels in the row, for example dependent upon or varied in proportion to the number of "on" pixels. This is beneficial because there is potentially a greater power saving to be made with a line in which many of the pixels are on than with a line with only a few "on" pixels. For example there is little to be gained by extending the line period or increasing the refresh rate of a line displaying only a single pixel but there are potentially much greater savings to be made by extending the line period or increasing the refresh rate of a line in which all the pixels are on. Further benefits may be obtained in this embodiment by adjusting the reference current drive/power supply voltage on a line-by-line basis rather than, for example, on a frame-by-frame basis.

It will be recognised that the functions of the above-described display driver control circuitry may be implemented using discreet components and/or integrated circuits or in silicon, or in an ASIC (Application Specific Integrated Circuits) or a FPGA (Field Programmable Gate Array), or by means of a dedicated processor with appropriate processor control code.

In another aspect the disclosure provides a display driver control circuitry for a passive matrix electroluminescent display, the display comprising a plurality of pixels arranged in rows and columns and addressed by row and column electrodes, the control circuitry being configured to address each row in turn to give the appearance of an image on the display, the control circuitry further comprising a frame memory interface for reading data from a frame memory for presentation on the display; a blank line identifier for identifying one or more substantially blank rows of pixels defined by said data; means to skip past said one or more blank rows of pixels during said row addressing; and a control output to provide a control signal for controlling a power supply for the display, said control signal varying dependent upon said identifying of one or more blank rows of pixels.

In a further aspect the disclosure provides a display driver circuitry for driving a matrix of electroluminescent display elements, the display elements being addressed by first and second pluralities of respective first and second electrodes, the display driver circuitry comprising first display interface circuitry for interfacing to said first electrodes; second display interface circuitry for interfacing to said second electrodes; control circuitry coupled to said first display interface circuitry and to said second display interface circuitry and configured to control said first and second display interface circuitry to activate successive sets of said display elements by activating successive ones of said first electrodes in combination with a set of said second electrodes; a memory, coupled to said control circuitry, for storing display information for identifying sets of said display elements which are inactive; and wherein said control circuitry is further configured to detect a said inactive set of display elements associated with one of said first electrodes and in response to said detection to activate a subsequent said first electrode without activation of said first electrode associated with said inactive set of elements.

In a still further aspect the disclosure provides a display driver circuitry for a pixellated organic light emitting diode display, the display having a plurality of first electrodes and a plurality of second electrodes for driving pixels of the display to luminesce, the display driver circuitry being configured to drive said electrodes to address lines of the display in turn and to detect and skip dark lines.

The disclosure also provides a method of reducing power consumption of a display having a plurality of lines, the method comprising reading data for presentation on said display; detecting one or more lines of said display which when said data is presented would be substantially blank; driving the display sequentially with data for said lines, skipping said substantially blank lines.

The reading may read the data for presentation from a frame store or it may read this data as it is written to a frame store.

The disclosure further provides processor control code, and a carrier medium carrying the code, to implement the above described methods and display driver circuitry functions. This code may comprise conventional program code or microcode or code for setting up or controlling an ASIC or FPGA. The carrier may comprise a storage medium such as a hard or floppy disk, CD- or DVD-ROM or programmed memory such as read-only memory (firmware), or a data carrier such as an optical or electrical signal carrier. As the skilled person will appreciate the code may be distributed between a plurality of coupled components in communication with one another.

The above-described control circuitry, methods and code are particularly advantageous when used with organic light emitting diode displays such as small molecule or polymer LED displays, especially passive matrix OLED displays.

These and other aspects of the disclosure will now be further described, by way of example only with reference to the accompanying figures in which:

FIGS. 1*a* and 1*b* show cross sections through, respectively, an organic light emitting diode and a passive matrix OLED display;

FIGS. 2*a* to 2*d* show, respectively, a conceptual driver arrangement for a passive matrix OLED display, a graph of current drive against time for a display pixel, a graph of pixel voltage against time, and a graph of pixel light output against time;

FIG. 3 shows a schematic diagram of a generic driver circuit for a passive matrix OLED display according to the prior art;

FIGS. 4*a* to 4*c* show, respectively, a light-voltage curve for an OLED display element, a current driver for a column of a passive matrix OLED display, and a current-voltage curve for an OLED display element;

Figure 1A:
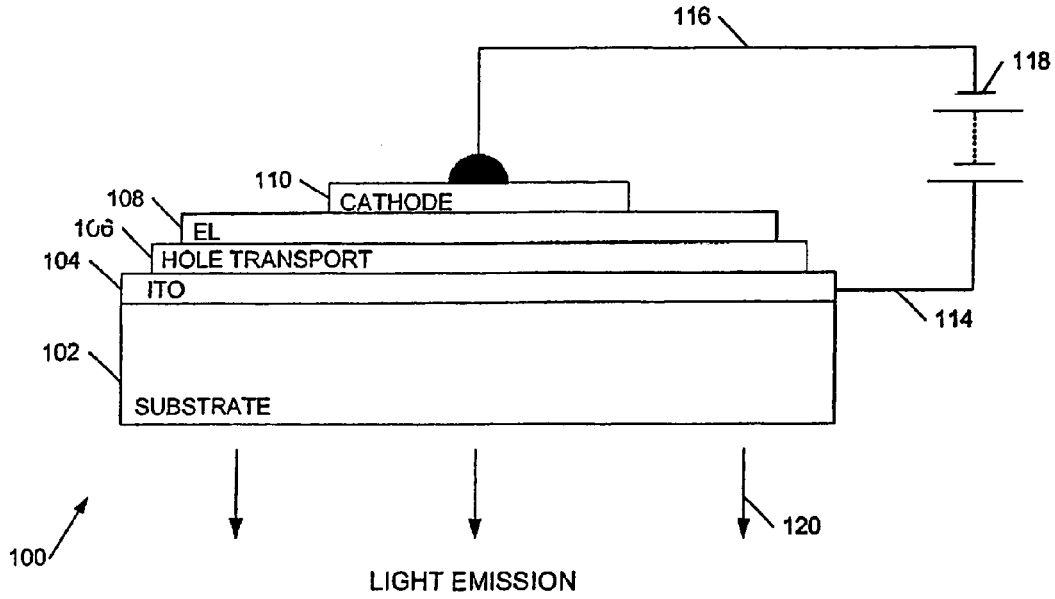
Figure 1a (PRIOR ART)
Figure 1B:
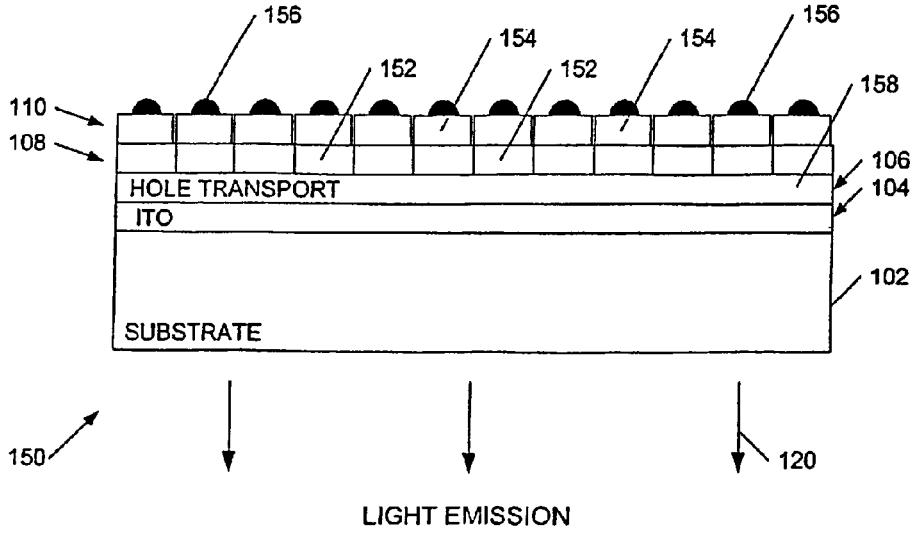
Figure 1b (PRIOR ART)
Figure 3:
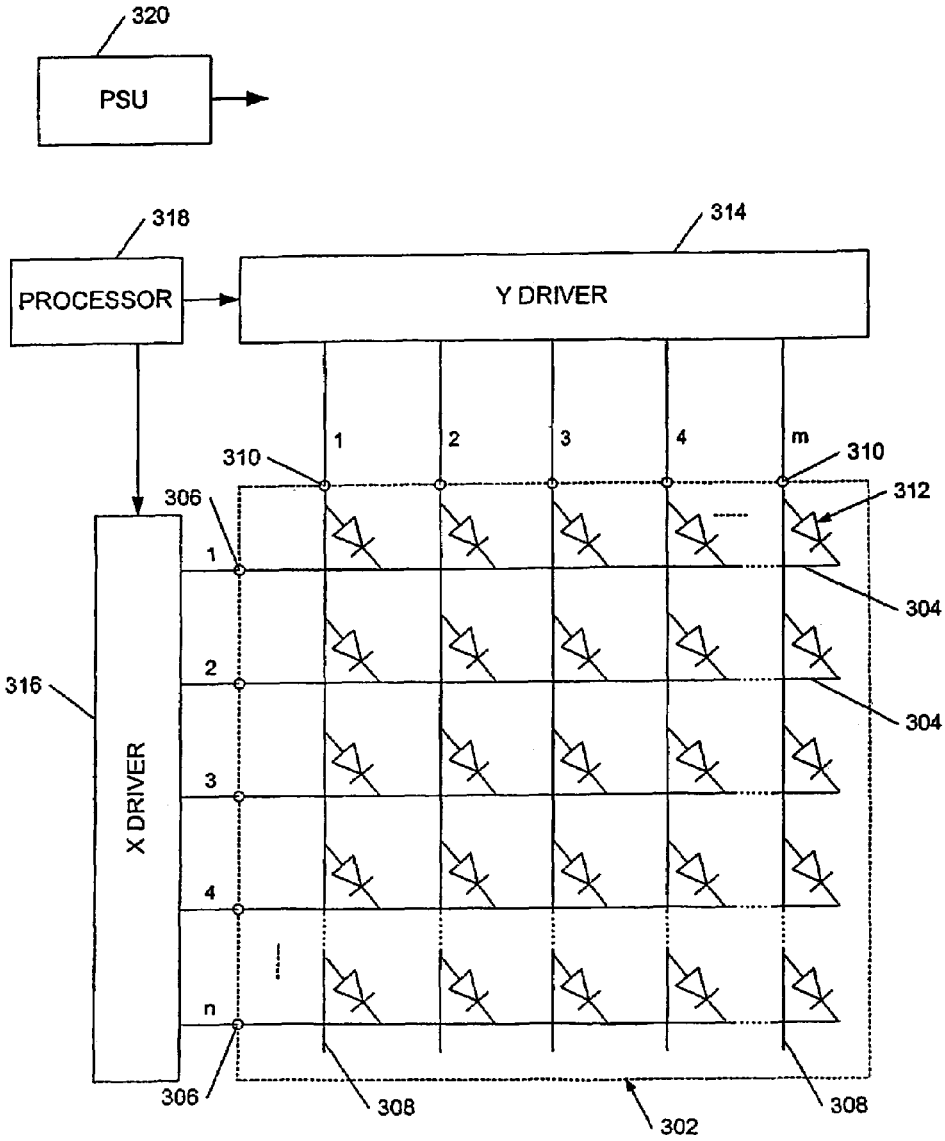
Figure 3 (PRIOR ART)
Figure 4A:
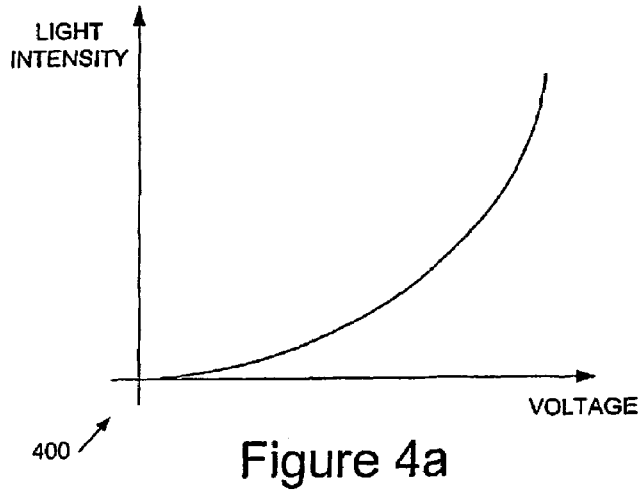
Figure 4B:
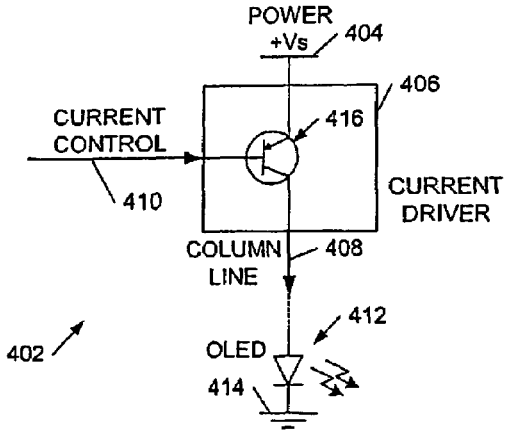

FIG. 4*b* shows, schematically, a current driver 402 for one column line of a passive matrix OLED display, such as the display 302 of FIG. 3. Typically a plurality of such current drivers are provided in a column driver integrated circuit, such as Y-driver 314 of FIG. 3, for driving a plurality of passive matrix display column electrodes.

A particularly advantageous form of current driver 402 is described in co-pending British patent application no. 0126120.5 entitled "Display Driver Circuits". The current driver 402 outlines the main features of this circuit and comprises a current driver block 406 incorporating a bipolar transistor 416 which has an emitter terminal directly connected to a power supply line 404 at supply voltage $V_S$. A column drive output 408 provides a current drive to OLED 412, which also has a ground connection 414, normally via a row driver MOS switch (not shown in FIG. 4*b*). A current control input 410 is provided to current driver block 406 and, for the purposes of illustration, this is shown connected to the base of transistor 416 although in practice a current mirror arrangement is preferred. The signal on current control line 410 may comprise either a voltage or a current signal and this is preferably provided from a digital-to-analog converter (not shown in FIG. 4*b*) for ease of interfacing.

Figure 4C:
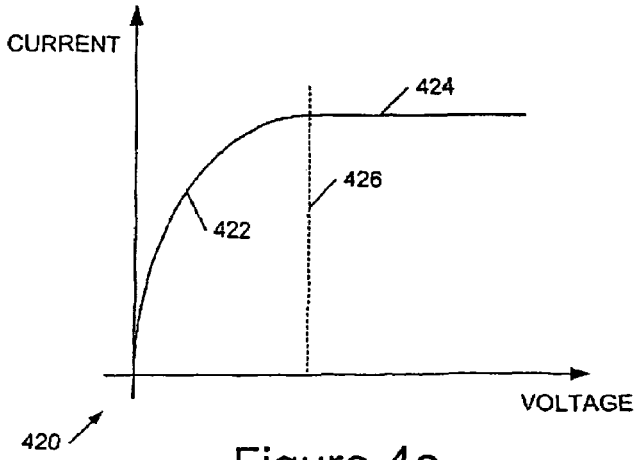

As previously explained current control is preferable to voltage control for an OLED because this helps to overcome the non-linearity of the light voltage curve shown in FIG. 4*a*, the light-current curve for an OLED being substantially linear. FIG. 4*c* shows a graph 420 of current drawn from a power supply against a power supply voltage for an organic LED display element driven from a controllable constant current source. An initial non-linear region 422 is followed by a substantially flat portion 424 of the curve above a voltage, indicated by dashed line 426, at which the supply voltage is sufficient to meet the compliance limit of the current source. In other words the. voltage indicated by dashed line 426 is the minimum supply voltage required to ensure that the constant current source is well behaved at the current it is controlled to provide.

It can be seen that in region 424 of the curve of graph 420 increasing the power supply output voltage merely increased the excess, wasted power dissipation and it is therefore preferable to operate at or near the compliance limit indicated by dashed line 426 to minimise this wasted power. It will be appreciated, however, that the position of voltage for this compliance limit will depend upon the current being provided by the constant current source.

Figure 5:
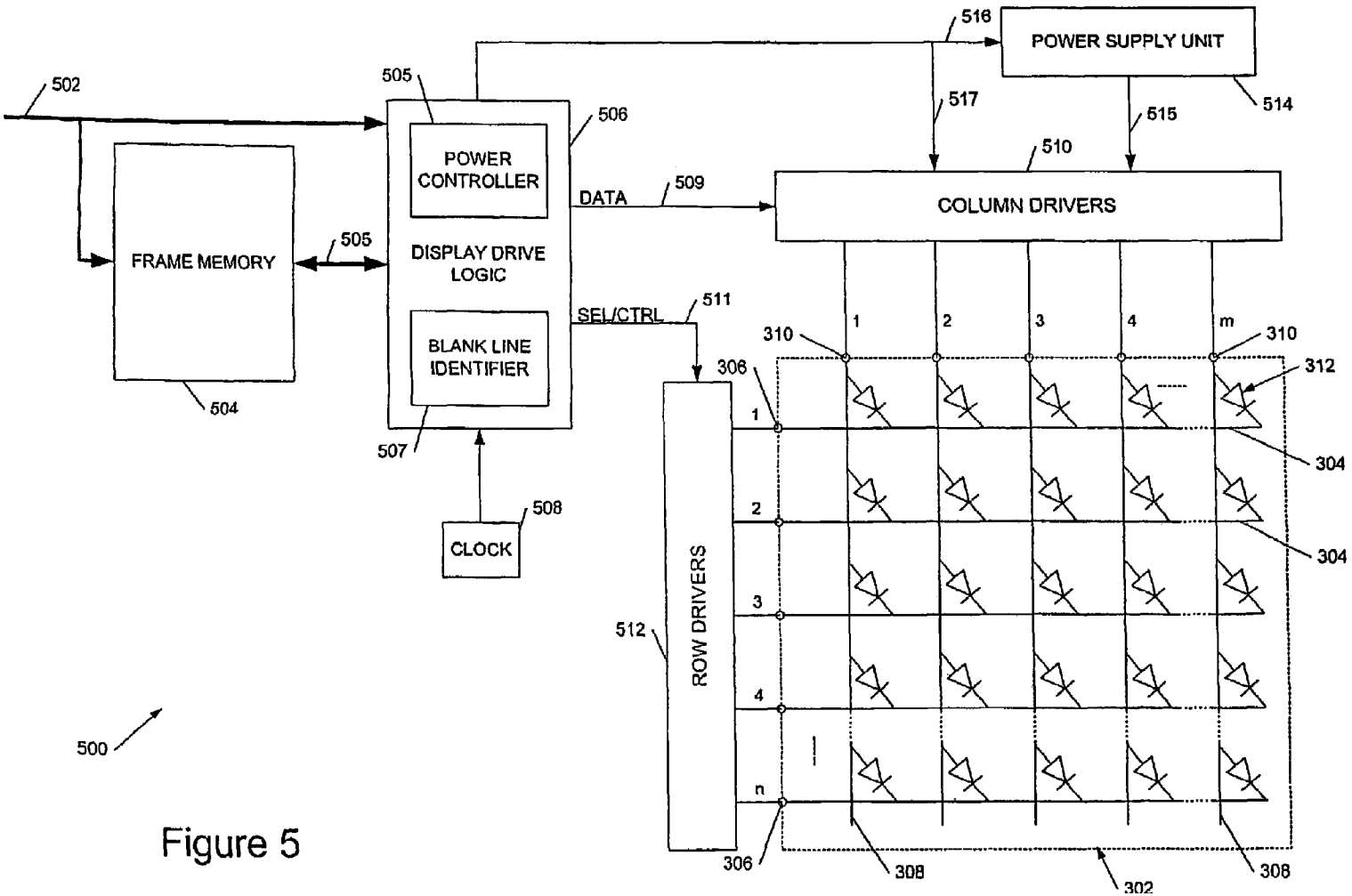
FIG. 5 shows a schematic diagram of passive matrix OLED driver circuitry according to an embodiment of the disclosure.

Turning now to FIG. 5, this shows a schematic diagram of an embodiment of a passive matrix OLED driver 500 which implements line skipping to save power, and which also controls a display power supply along the lines indicated by the foregoing discussion.

In FIG. 5 a passive matrix OLED display 302, similar to that described with reference to FIG. 3, has row electrodes 306 driven by row driver circuits 512 and column electrodes 310 driven by column drivers 510. The driver for each row typically comprises a MOS transistor to selectively connect a row electrode to ground; the driver for each column in a preferred embodiment comprises a controllable current source such as that described with reference to FIG. 4*b*. Row driver circuits 512 have a control input 511 for selecting one (or more) row electrodes for connection to ground. Column drivers 510 have a control input 509 for setting the current drive to one or more of the column electrodes. Preferably control inputs 509 and 511 are digital inputs for ease of interfacing and preferably control input 509 sets the current drives for all the m columns of display 302. A two-dimensional image may be presented on display 302 by selecting each row in turn and driving all the pixels in the selected row using column drivers 510, then selecting the next row and repeating the process to build up an image using a conventional raster scan pattern. Where a greyscale or colour display is to be provided a variable current drive is provided for each column according to the desired pixel brightness. In some embodiments of row driver circuitry 512 the raster scan function may be provided automatically by the row drivers under control of the control input 511.

A power supply unit 514 provides power to the various elements of the display driver 500 and, in particular, has an output 515 for powering the column drivers 510. The power supply unit 514 also has a control input 516 for controlling the output voltage provided to the column drivers on line 515. In embodiments the column drivers 510 also have a control input 517 for setting a reference current drive level, for use by the individual column drivers. Thus, for example, control input 517 may provide a control signal for a reference current (or voltage) generator supplying a reference current (or voltage) to a digital-to-analogue converter or converters providing current control signals to current drivers for the individual columns. In some embodiments of driver 500 control inputs 516 and 517 may both receive the same signal.

Data for display on display 302 is provided on data and control bus 502 which comprises, for example, at least one data line and a write line. Bus 502 may be either a parallel or a serial bus. Bus 502 provides an input to a frame store or memory 504 which stores display data for each pixel of display 302, in effect forming in the memory an image of the data for display. Thus, for example, one or more bits of memory may be associated with each pixel, defining a greyscale pixel brightness level or a pixel colour. The data in frame store 504 is stored in such a way that the brightness values of pixels in a row may be read out and, in the illustrated embodiment, frame store 504 is dual ported, outputting data read from the frame store on a second, read data bus 505. In other embodiments the functions of data bus 502 and data bus 505 may be combined in a single data bus.

The passive matrix OLED driver 500 also incorporates display drive logic 506, for providing display data to control input 509 of column drivers 510 and for providing a row select or scan control output to control input 511 of row drivers 512 for controlling the raster scanning of the display. The timing or processing performed by display drive logic 506 is controlled by a clock signal from clock generator 508. The display drive logic 506 is also coupled to read data and control bus 505 for reading data from frame memory 504.

Display drive logic 506 operates in a conventional manner to read data from frame memory 504 and to provide control data signals to control inputs 509 and 511 to display this data on passive matrix display 302. However display drive logic 506 also includes a blank line identifier 507, with internal memory, to identify and skip past rows of pixels which the data stored in frame memory 504 indicates are blank or substantially non-illuminate. Likewise display drive logic 506 further includes a power controller 505 for providing control signals to control inputs 516 and 517 of power supply unit 514 and column drivers 510 respectively.

In operation display drive logic 506 reads data from frame memory 504 line by line that is, row-by-row of display pixels, and if a line is entirely blank display of that line in the raster scan pattern is skipped and data for the subsequent line of pixels is read. If a line of pixels read from frame memory 504 is not blank the appropriate row of display 302 is selected and column drivers 510 are controlled to drive the columns of the display 302 at a level to illuminate each pixel of the row with an appropriate brightness, as determined by the stored data. This row is then displayed for a line period before data for the next line is read and again checked to determine whether or not the line is substantially blank. These functions, and in particular the blank line identification, may be performed by a state machine implemented on a PLA (Programmable Logic Array).

The display drive logic 506, and in particular power controller 505, is also configured to determine the number of non-illuminated lines (or alternatively the number of non-blank lines) in order to provide control signal outputs for control inputs 516 and 517, for controlling the maximum drive current provided to the display. In one embodiment the maximum drive current is set on a frame-by-frame basis and is reduced in proportion to the number of blank lines. Similarly a control signal is provided to power supply unit 514 to control this power supply so that the voltage on line 515 to column drivers 510 is substantially no more than required for the maximum current drive for the frame. This may readily be determined based upon a known or assumed compliance limit for the column current drivers.

The number of blank lines may be determined simply by reading display data for a whole frame from frame memory 504 and counting the number of blank lines. This may be done very quickly, for example using sequential logic or during readout of a previous frame. Alternatively where bus 505 is very wide, for example because frame memory 504 is integrated with display drive logic 506, combinational logic may be employed to identify which, and how many, lines are blank.

When display drive logic 506 identifies a blank line, this line may be skipped and the next non-blank line read, to maintain a substantially constant line rate. In this way the non-blank lines are refreshed more frequently to increase their effective brightness. However it is preferable to slow the line rate down to maintain a substantially constant frame rate, and hence dwell longer on each non-blank line to increase its apparent brightness. By slowing the line refresh rate down in this way power consumption is further reduced by reducing capacitative losses. In this latter arrangement the average line rate is scaled by a factor of n/1 where n is the total number of rows and 1 is the number of blank rows.

In a refinement of this latter arrangement the line period may be altered on a line-by-line basis according to the number of illuminated pixels in the line. Thus although the average (extended) line period may remain substantially the same, the line period for lines with large numbers of illuminated pixels may be further extended whilst the line period for lines with fewer than average pixels may be shortened to below the average (extended) line period. This is beneficial because the power savings to be made by extending the line period for lines with only small numbers of illuminated pixels are relatively small whereas the savings to be made by extending the line period for lines with large numbers of illuminated pixels are much greater.

In a variant of the above-described embodiment display drive logic 506 receives an input from databus 502 and blank line identifier 507 performs bus snooping to track the status of data stored in frame memory 504. Thus blank line identifier 507 snoops bus 502 to identify data writes to frame memory 504 and then keeps a record in internal memory of which lines are blank. Theoretically with this arrangement it is possible to dispense with data bus 505 although in practice a read from frame memory 504 may be used to determine an initial condition from which changes can be tracked and, preferably, further periodic reads may be employed to validate the blank line status information.

Figure 6:
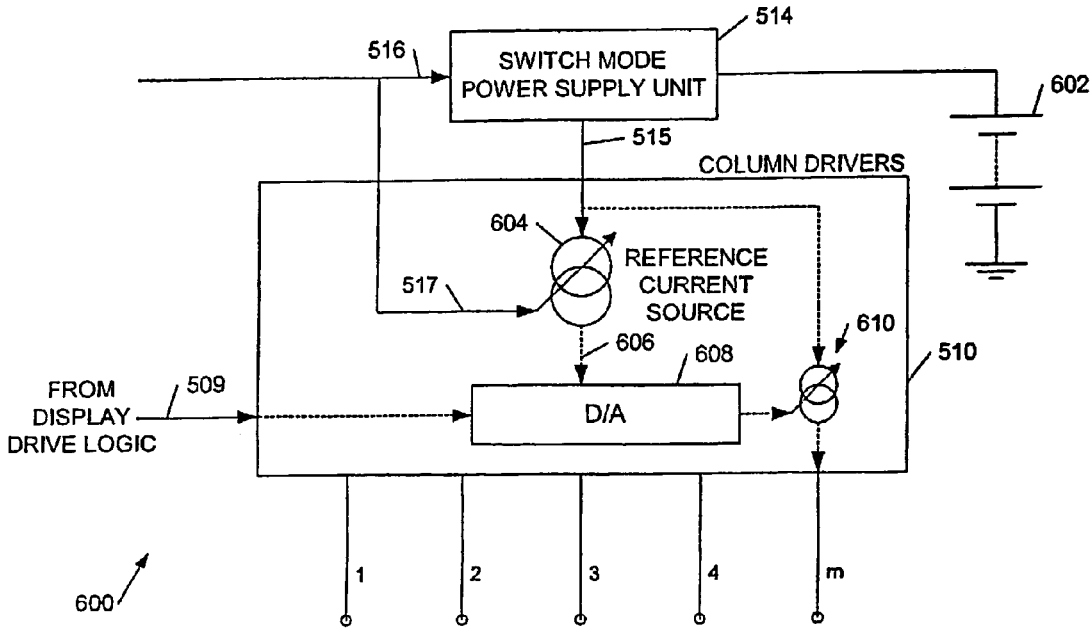
FIG. 6 shows details of a power supply arrangement for the circuitry of FIG. 5.

Referring now to FIG. 6 this shows power supply unit 514 and column drivers 510 in more detail. Power supply unit 514 is preferably a switch mode power supply, with an input from a battery 602, preferably of a relatively low voltage, for example 3 volts, for compatibility with typical portable consumer electronic devices. The voltage provided on power supply output line 515 will generally be higher than the battery voltage, typically between 5 volts and 10 volts, for driving a passive matrix OLED display to provide desirable brightness.

Column driver circuitry 510 includes a controllable reference current source 604 controlled by an input signal on control line 517 and providing a reference current output on line 606 used, for example, by a digital-to-analogue converter 608. Power line 515 also supplies a plurality of controllable current generators 610 (of which, for convenience, only one is shown) providing column drive current outputs. The current for each column is set by controlling each current generator 610 using D/A converter 608 which, in turn, receives control signals on line 509 from display drive logic 506. As previously described, display drive logic 506 provides control signals on lines 516 and 517 to vary the maximum current drive to pixels in a row (on a frame-by-frame basis) dependent upon the number of non-blank rows displayed, and hence dependent upon the line period or line refresh rate. It will be appreciated that in other embodiments reference current source 604 may be dispensed with, for example a reference or maximum drive current being set by the voltage on power supply output line 515.

Figure 7:
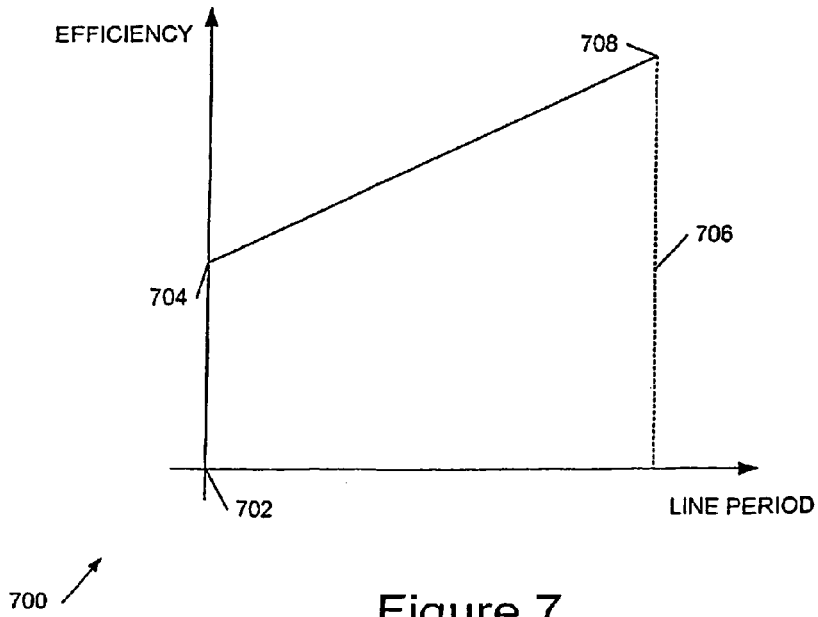
FIG. 7 shows a graph indicating a variation in efficiency of the circuit of FIG. 5 as a display line period changes.

FIG. 7 shows a graph 700 showing how the efficiency of driver 500 of FIG. 5 varies as the average line period changes. At the origin 702 of the graph there are no non-blank lines and the line period is a minimum, equal to frame period divided by the number of lines. At this point the efficiency 704 is merely that of a conventional display. However as the number of blank lines increases so does the line period, and hence the overall power efficiency. Dashed line 706 indicates an increased line period due to the presence of blank lines in the display and, consequently, an increased efficiency 708. Where the frame rate rather than the line period is increased by the presence of blank lines a graph similar to that shown in FIG. 7 may be drawn except that frame rate rather than line period is on the x-axis.

No doubt many effective alternatives will occur to the skilled person. For example display drive logic 506 may be implemented using a microprocessor under software control rather than in dedicated logic, or a combination of a microprocessor and dedicated logic may be employed. Where a microprocessor is employed buses 502 and 505 may be combined in a shared address/data/control bus, although again frame memory 504 is preferably dual-ported to simplify interfacing the display to other devices. It should be understood that the disclosure is not limited to the described embodiments but encompasses modifications apparent to those skilled in the art lying within the spirit and scope of the claims appended hereto.

The invention claimed is:

1. Display driver control circuitry for a passive matrix emissive display, the display comprising a plurality of pixels arranged in rows and columns and addressed by row and column electrodes, the control circuitry being configured to address each row in turn to give the appearance of an image on the display, the control circuitry further comprising:

a frame memory interface for reading data from a frame memory for presentation on the display;

a blank line identifier for identifying one or more substantially blank rows of pixels defined by said data;

wherein the control circuitry is further configured to skip past said one or more blank rows of pixels during said row addressing without addressing of the blank rows;

a set of column drivers each including a column drive controllable current generator, each said column drive controllable current generator having a first power supply input to receive a power supply from said display driver control circuitry and a second current control input and having a column drive output to provide a column drive to said display;

wherein said set of column drivers further comprises at least one digital-to-analogue converter having a digital input to receive a pixel brightness control signal and having an analogue output coupled to a said second current control input of said column drive controllable current generator; and a reference current or voltage generator to set a reference current or voltage for said set of column drive controllable current generators, said reference current or voltage generator having a power supply input to receive power from said power supply and a reference current or voltage control input to control said reference current or voltage; and wherein said display driver control circuitry further comprises a reference drive signal line coupled to said reference current or voltage control input to provide a reference control signal for scaling a set of column drives from said set of column drive controllable current generators; and wherein said reference control signal is configured to control said reference current or voltage generator in proportion to the number of identified blank rows of pixels such that a perceived pixel brightness remains substantially constant as the number of identified blank rows of pixels varies.

2. Display driver control circuitry as claimed in claim 1 wherein said control circuitry is further configured to maintain a substantially constant frame rate for the display.

3. Display driver control circuitry as claimed in claim 1 further comprising a control output to provide a control signal for controlling a power supply for the display, said control signal varying dependent upon said identifying of one or more blank rows of pixels.

4. Display driver control circuitry as claimed in claim 1 further comprising power supply control output for controlling the voltage of a power supply for the display.

5. Display driver control circuitry as claimed in claim 4 wherein said control circuitry is configured to control said power supply control output such that said power supply voltage is substantially at a compliance limit of said column drive controllable current generator.

6. Display driver control circuitry as claimed in claim 4 further comprising switch mode power supply circuitry for said power supply.

7. Display driver control circuitry as claimed in claim 1 further comprising a controllable current generator for providing said current drive to the display.

8. Display driver control circuitry as claimed in claim 1 wherein said blank line identifier is configured to identify said one or more blank rows of pixels using data read from said frame memory.

9. Display driver control circuitry as claimed in claim 1 wherein said blank line identifier is configured to identify said one or more blank rows of pixels by tracking data written to said frame memory.

10. Display driver control circuitry as claimed in claim 1 wherein said control circuitry is further configured to vary a line period during which a row of said display is addressed, dependent upon the brightness of pixels in said row.

11. Display driver control circuitry as claimed in claim 1 further comprising a plurality of column drivers for driving said column electrodes.

12. Display driver control circuitry as claimed in claim 1 further comprising a plurality of row drivers for driving said row electrodes.

13. Display driver control circuitry as claimed in claim 1 further comprising said frame memory.

14. Display driver control circuitry as claimed in claim 1 for an organic light emitting diode-based passive matrix display.

15. Display driver control circuitry as claimed in claim 1 wherein said reference current or voltage generator is configured to provide a reference current or voltage for said at least one digital-to-analogue converter and has a reference current or voltage output coupled to a reference input of said at least one digital-to-analogue converter.

16. Display driver control circuitry as claimed in claim 1 wherein said reference current or voltage generator comprises a reference voltage generator having a reference voltage output coupled to said power supply input of each said column drive controllable current generator.

* * * * *

UNITED STATES PATENT AND TRADEMARK OFFICE

CERTIFICATE OF CORRECTION

PATENT NO. : 7,474,288 B2
APPLICATION NO. : 10/512379
DATED : January 6, 2009
INVENTOR(S) : Euan C. Smith et al.

It is certified that error appears in the above-identified patent and that said Letters Patent is hereby corrected as shown below:

Title Pg,

Item (57) Abstract, line 12, “power-controller” should be -- power controller --.

Signed and Sealed this

Twenty-sixth Day of May, 2009

John Doll

JOHN DOLL
*Acting Director of the United States Patent and Trademark Office*